US008844587B1

(12) United States Patent
McCommons

(10) Patent No.: US 8,844,587 B1
(45) Date of Patent: Sep. 30, 2014

(54) LOCKING FUEL PUMP DISPENSER

(71) Applicant: James A. McCommons, Daytona Beach, FL (US)

(72) Inventor: James A. McCommons, Daytona Beach, FL (US)

( * ) Notice: Subject to any disclaimer, the term of this patent is extended or adjusted under 35 U.S.C. 154(b) by 0 days.

(21) Appl. No.: 14/069,466

(22) Filed: Nov. 1, 2013

(51) Int. Cl.
*B65B 1/04* (2006.01)
*B67D 7/06* (2010.01)
*B67D 7/42* (2010.01)

(52) U.S. Cl.
CPC . *B67D 7/42* (2013.01); *B67D 7/065* (2013.01)
USPC ..... 141/347; 141/207; 141/383; 141/392

(58) Field of Classification Search
CPC ..... B67D 7/42; B67D 7/065
USPC ..... 141/206–226, 346–347, 371, 383, 392; 220/86.2
See application file for complete search history.

(56) References Cited

U.S. PATENT DOCUMENTS

| | | | | |
|---|---|---|---|---|
| 1,457,535 | A * | 6/1923 | McCune | 141/312 |
| 3,881,528 | A | 5/1975 | Mackenzie | |
| 4,109,686 | A | 8/1978 | Phillips | |
| 4,133,355 | A | 1/1979 | Mayer | |
| 4,262,712 | A | 4/1981 | Young | |
| 4,354,536 | A * | 10/1982 | Moss | 141/383 |
| 4,367,827 | A | 1/1983 | Keller et al. | |
| 4,469,149 | A | 9/1984 | Walkey et al. | |
| 4,557,302 | A | 12/1985 | Sunderhaus | |
| 4,907,630 | A | 3/1990 | Kulikowski et al. | |
| 5,121,777 | A | 6/1992 | Leininger et al. | |
| 5,127,451 | A | 7/1992 | Fink, Jr. et al. | |
| 5,156,198 | A | 10/1992 | Hall | |
| 5,301,723 | A * | 4/1994 | Goode | 141/82 |
| 5,609,192 | A | 3/1997 | Anderson et al. | |
| 5,720,327 | A | 2/1998 | Foster, Jr. | |
| 5,727,608 | A | 3/1998 | Nusbaumer et al. | |
| 5,729,002 | A | 3/1998 | Samples | |
| 5,857,501 | A | 1/1999 | Kelerich et al. | |
| 5,918,766 | A | 7/1999 | Osborne | |
| 6,142,194 | A | 11/2000 | McClaran | |
| 6,157,871 | A | 12/2000 | Terranova | |
| 6,334,474 | B1 | 1/2002 | Rababy et al. | |
| 6,957,674 | B2 | 10/2005 | Burr | |
| 6,962,177 | B1 | 11/2005 | McCommons | |
| 7,000,657 | B1 * | 2/2006 | Thorpe et al. | 141/207 |
| 7,082,972 | B1 | 8/2006 | Healy | |
| 7,575,028 | B2 * | 8/2009 | Thorpe et al. | 141/347 |
| 2014/0048173 | A1 * | 2/2014 | Fedde et al. | 141/311 A |

* cited by examiner

*Primary Examiner* — Timothy L Maust
*Assistant Examiner* — Timothy P Kelly
(74) *Attorney, Agent, or Firm* — William M. Hobby, III

(57) ABSTRACT

The present invention relates to a locking fuel pump fuel dispenser nozzle and especially to a locking fuel pump fuel dispenser nozzle having a locking mechanism for automatically locking a fuel nozzle spout in the vehicle filler tube whenever fuel is being pumped into the vehicle filler tube and fuel tank and which can be unlocked only when fuel pressure from the fuel pump is cut off.

10 Claims, 4 Drawing Sheets

LOCKING FUEL PUMP DISPENSER

FIELD OF THE INVENTION

The present invention relates to a locking fuel pump fuel dispenser nozzle and especially to a locking fuel pump fuel dispenser nozzle having a locking mechanism for automatically locking the fuel nozzle spout in the vehicle filler tube whenever fuel is being pumped into the vehicle fuel tank filler tube and fuel tank and which can be unlocked only when the fuel pressure from the fuel pump is cut off.

The refueling of vehicles usually employs a fuel pump having a supply hose with a nozzle and with a manually operated valve. The nozzle includes a spout insertable into the vehicle fuel tank inlet or filler tube. The nozzle valve is manually operated by a handle and a tube within the spout senses the rising fuel within the inlet neck and automatically closes the nozzle valve upon sensing the presence of the fuel level to thereby prevent overflow and spillage. However accidental spilling and the release of gasoline vapors occurs when removing the nozzle spout from the filler tube upon completion of the filling operation when there is still fuel under pressure from the pump in the nozzle. It is thus desirable to prevent dispensing of fuel through the nozzle unless the spout is fully inserted into the tank filler tube and to prevent dispensing of fuel during and upon removing of the nozzle spout from the tank filler tube.

The present invention is directed towards locking of the nozzle spout into the vehicle filler tube until all fuel pressure is cut off at the nozzle so that the nozzle cannot be prematurely removed from the filler tube or actuated after removing from the filler tube.

In my prior U.S. Pat. No. 6,962,177 for a Locking Fuel Pump Dispenser, a locking fuel pump fuel dispenser nozzle has a locking mechanism for automatically locking the fuel nozzle spout in the vehicle filler tube whenever fuel is being pumped into the vehicle filler tube and fuel tank. The nozzle is prevented from being removed from the fuel tank filler tube until being remotely released by a filling station operator upon payment being made for the supplied fuel.

The prior art Kulikowski et al. U.S. Pat. No. 4,907,630 is for an automatic shut-off and self-locking refueling nozzle. This refueling nozzle has means for attaching the nozzle to the vehicle tank inlet neck and inlet port and provides for automatic shut-off of the refueling nozzle. In one embodiment, a secondary control valve prevents fluid flow until the nozzle has been fully connected to the inlet tank. The Fink, Jr. et al. U.S. Pat. No. 5,127,451 is for a fuel dispensing nozzle having a bellows on the spout and a valve which is opened in response to inserting the nozzle spout into the filler tube. Removal of the spout causes the bellows to expand and the valve to close. The Healy U.S. Pat. No. 7,082,972 is for a fuel delivery nozzle having a lockout mechanism which resists opening the nozzle valve until a boot surrounding the spout engages the surface of the edge of the fill tube which permits actuation of the valve.

The Mackenzie U.S. Pat. No. 3,881,528 has a hose nozzle which allows the flow of fuel when the nozzle is properly seated in the filler tube. The Young U.S. Pat. No. 4,262,712 is for a magnetically latchable liquid dispensing nozzle. The Leininger et al. U.S. Pat. No. 5,121,777 has a bellows around the spout which is compressed to sealingly engage the outer end of the fill tube. Interlock means is responsive to compression of the bellows engaging a latching means with a trip stem to latch the nozzle spout in an operative position. The Burr U.S. Pat. No. 6,957,674 is for a locking fuel nozzle. The Mayer U.S. Pat. No. 4,133,355 is for a sealable dispensing nozzle with an automatic shutoff. The McClaran U.S. Pat. No. 6,142,194 is a pressure fuel servicing nozzle for fueling aircraft and has an interlock. The Anderson U.S. Pat. No. 5,609,192 is for a fuel dispenser while the Sunderhaus U.S. Pat. No. 4,557,302 is for a retainer ring for the spout of a fluid dispenser.

Other prior art U.S. patents relating to the fueling of vehicles include the Phillips U.S. Pat. No. 4,109,686 and is for adjusting the vehicle gasoline filler apparatus which suggests a locking system for the fuel nozzle which is released only by proper engagement with a receiver and connects the fuel nozzle to the filler neck with a bayonet type connection. The customer twists the nozzle after insertion into the filler neck of the gasoline tank passing the lugs against the stop provided in grooves. The Keller U.S. Pat. No. 4,367,827 is for an anti-theft mechanism for a gasoline pump and is designed to prevent drive-off by having a patron place his ignition key into a switch mechanism which automatically clamps and maintains the key until the key is released by operation of a remote switch. The Walkey et al. U.S. Pat. No. 4,469,149 is for a monitored delivery system which provides on the fuel nozzle an optical bar code reader for reading a bar code for determining whether a given vehicle is authorized to receive fuel. The Hall U.S. Pat. No. 5,156,198 is for a pump lock fuel system which provides a communication link between a vehicle and a fuel distribution system prior to pumping fuel to the vehicle. The Foster, Jr. U.S. Pat. No. 5,720,327 is for a vehicle safety fueling system for preventing accidental drive-off of the vehicle from a fuel pump without first removing a fuel dispensing nozzle. The Nusbaumer et al. U.S. Pat. No. 5,727,608 is for an automated fuel management system. A fuel dispenser station has a fuel dispensing nozzle adapted for mating with and being secured to a fuel receiving tank. The Samples U.S. Pat. No. 5,729,002 is for an electronic bar coded gasoline scanner. A bar code is imprinted within a top portion of a gasoline tank fill pipe and a laser scanner is secured to the gasoline dispensing nozzle. The Kelerich et al. U.S. Pat. No. 5,857,501 is a fueling system identification system having an inductive communication loop arranged to surround a fuel intake pathway of a vehicle for reading and transmitting the vehicle identification number, credit information and the like. The Osborne U.S. Pat. No. 5,918,766 is a locking forecourt fuel pump for locking a delivery nozzle in the pump. The Terranova U.S. Pat. No. 6,157,871 is for a fuel dispensing system for preventing customer drive-off and provides a control system for detecting where the drive-off has taken place and using this signal to cause a remote communication to prevent future transactions involving that customer. The Rababy et al. U.S. Pat. No. 6,334,474 is a breakaway separation detection and alert system for preventing and minimizing damage caused by breakaway separation in the fuel lines supplying the fuel nozzle.

The present invention in contrast is for a locking fuel pump fuel dispenser nozzle which locks the spout of the fuel pump nozzle into the vehicle filler tube automatically when a patron starts to deliver fuel to the vehicle. The nozzle spout then remains locked to the vehicle filler tube until the pressure is cut off to the nozzle at the gas pump and is used to prevent spillage of fuel when removing the nozzle spout from the vehicle tank filler tube.

SUMMARY OF THE INVENTION

This invention relates to a locking fuel pump fuel dispenser nozzle having a nozzle connected to a fuel pump and having an elongated spout for insertion into a vehicle filler tube having an annular raised surface therein and is which the nozzle has a manually actuating valve for controlling the flow of fuel from the fuel pump through the nozzle and into the vehicle filler tube. The improvement is for a locking mechanism for locking the nozzle spout in the filler tube when filling a vehicle's fuel tank. The locking mechanism includes a nozzle tube having a spring biased locking wedge thereon adapted to extend between an unlocked and a locked position. The nozzle tube is located in the nozzle spout. The locking mechanism has a slidable actuator located in the nozzle tube positioned to move the locking wedge from an unlocked to a locked position. The locking mechanism nozzle spout has a piston in a piston housing therein coupled to the slidable actuator to move the slidable actuator and move the locking wedge from an unlocked to a locked position whenever fluid pressure is applied to the piston. Means are provided to retract the locking wedge from a locked position to an unlocked position whenever fuel pressure to the nozzle is cut off. Thus a fuel dispenser nozzle spout locks into a vehicle fuel tank filler tube whenever fuel pressure is applied to the nozzle and is unlocked only upon the absence of fuel pressure in the nozzle.

BRIEF DESCRIPTION OF THE DRAWINGS

The accompanying drawings, which are included to provide further understanding of the invention are incorporated in and constitute a part of the specification, and illustrate an embodiment of the invention and together with the description serve to explain the principles of the invention.

In the drawings.

DETAILED DESCRIPTION OF EXEMPLARY EMBODIMENT

Figure 1:
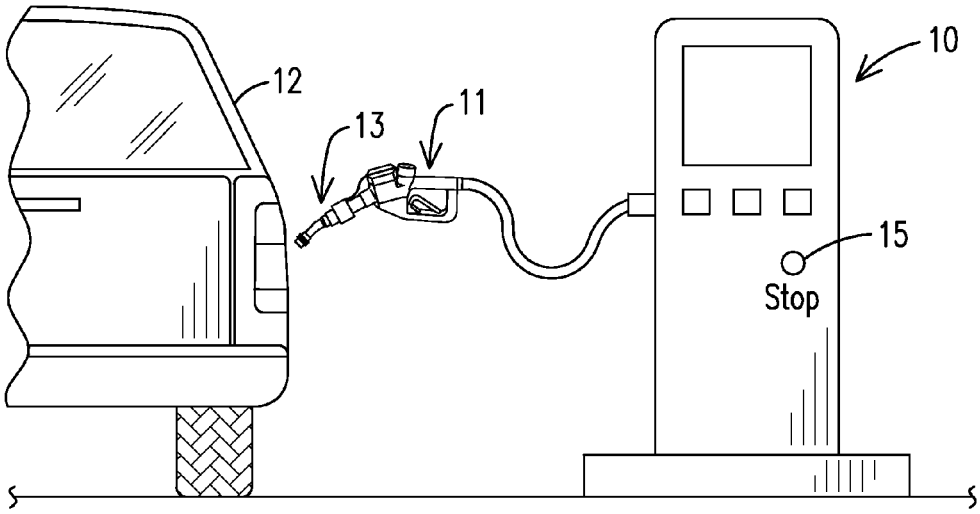
FIG. 1 is a diagrammatic view of a fuel pump and fuel nozzle.
Figure 2:
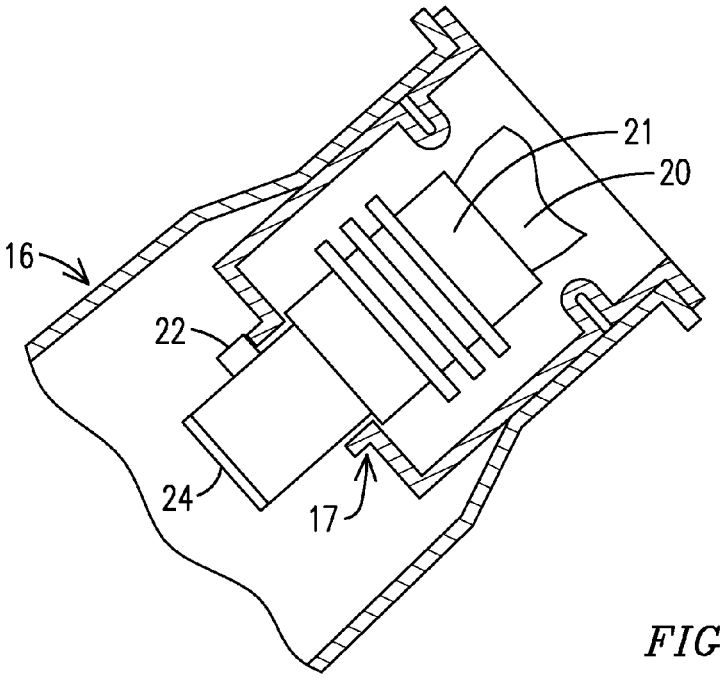
FIG. 2 is a sectional view of fuel filler tube having a fuel nozzle spout locked therein in accordance with the present invention.

As seen in FIG. 1 of the drawings, this invention relates to a fuel pump 10 fuel dispenser nozzle 11 for fueling a vehicle 12. The nozzle 11 has a spout 13 and a valve actuation handle 14 which is depressed to start the fuel flow into the vehicle. The fuel pump has a fuel stop switch 15 which is used to cut the fuel flow and pressure to the nozzle 11 and which may also be used to start the flow of fuel to the nozzle. The nozzle 13 is inserted into the gas tank filler tube 16 of the vehicle 12 which has a restrictive inlet opening 17 as seen in FIG. 2 which has a narrowed opening which allows the end of the nozzle 11 nozzle tube 20 to pass through while blocking and sliding the outer sleeve member 21 to uncover a locking wedge member 22 in the nozzle tube 20 so that the locking wedge can protrude from the nozzle tube to lock the nozzle tube 20 and nozzle 11 to the fuel filler tube 16. The outer sleeve member 21 also uncovers the auto-shutoff opening 37 at the lower front end of the nozzle tube, allowing fuel to flow without engaging the auto-shutoff. Fuel will not flow if the auto-shutoff hole is covered by the outer sleeve member 21.

In the drawings, FIGS. 2 through 5, the locking fuel pump fuel dispensing nozzle 11 has a locking mechanism for automatically locking the fuel nozzle spout 13 in the vehicle filler tube 16 whenever fuel is being pumped into the vehicle filler tube and fuel tank and which can be unlocked only when the fuel pressure from the fuel pump is cut off. The outer sleeve member 21 slides on the nozzle tube 20 and is spring biased by a coil spring 23 to cover the locking wedge 22 until it is pushed back by the filler tube 16 restricted opening 17. A stop cap 24 limits the sliding of the outer sleeve member 21. The locking wedge 22 is attached onto the end of a leaf spring 25 which holds the locking wedge in the nozzle tube until it is pushed out by the actuator 26 cylindrical end 27 sliding against the spring 25.

A piston housing 30 houses a sliding piston 31 and has a fuel line 32 attached from the nozzle 11 into the chamber in the piston housing 30 behind the piston 31. The piston 31 is driven forward against the piston return spring 33 by pressure from fuel passing into the piston housing chamber when the nozzle 11 is activated for fueling a vehicle. The moving piston 31 pushes against a slip ring 34 which drives the actuator 26 to slide forward to drive the locking wedge 22 to lock the nozzle in the filler tube. An actuator return spring 35 returns the actuator to an unlocked position to release the locking wedge 22 only when the fuel pressure is cut off to the piston housing 30 which only occurs when the fuel pump 10 is turned off. The fuel pump is turned off by a fuel dispensing cutoff 15 or by a standard nozzle cradle on the pump 10 being pushed down. A pressure relief spring 36 biases the slip ring 34 to maintain the slip ring in position against the piston 31.

Figure 3:
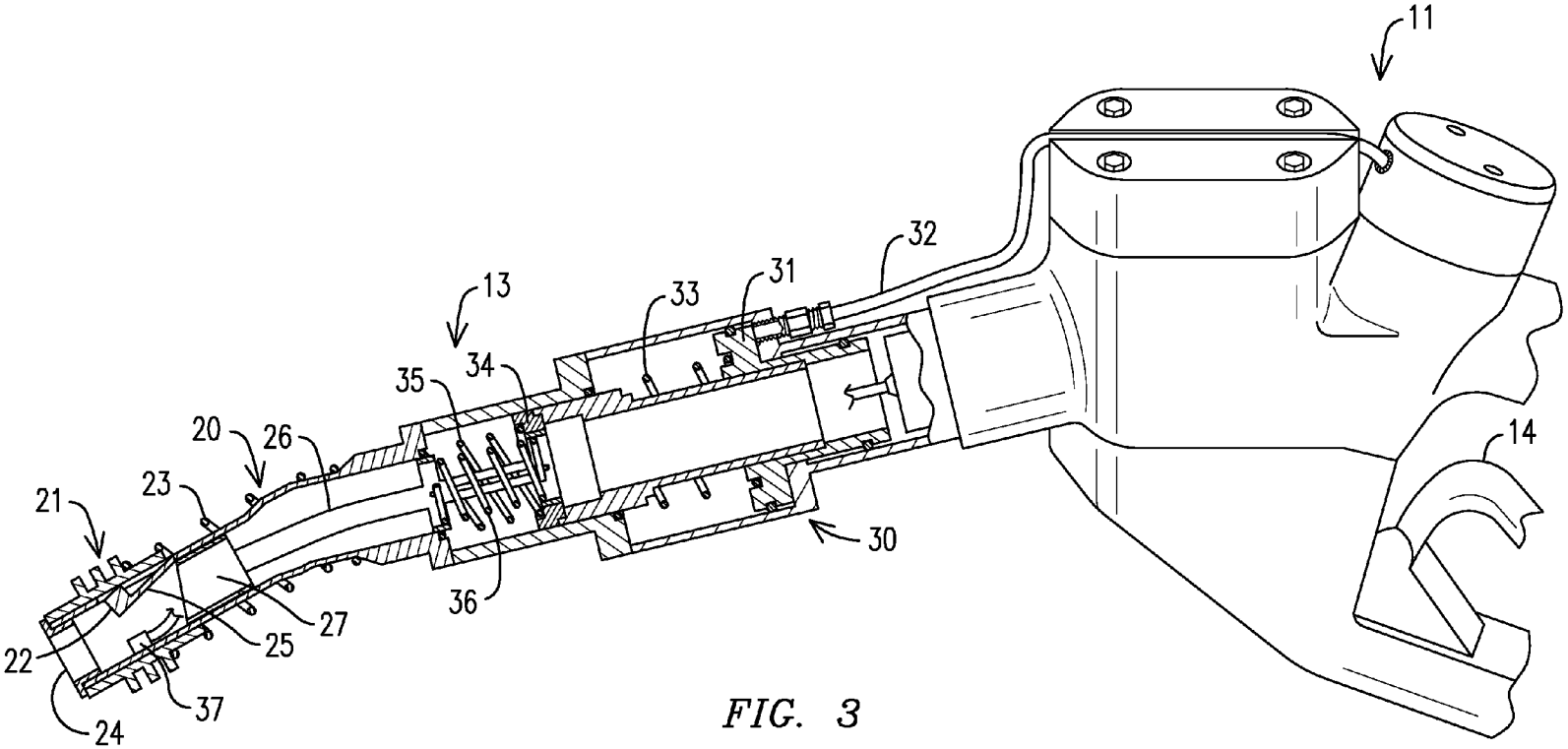
FIG. 3 is a sectional view of a fuel pump nozzle in accordance with the present invention in an unlocked position.
Figure 4:
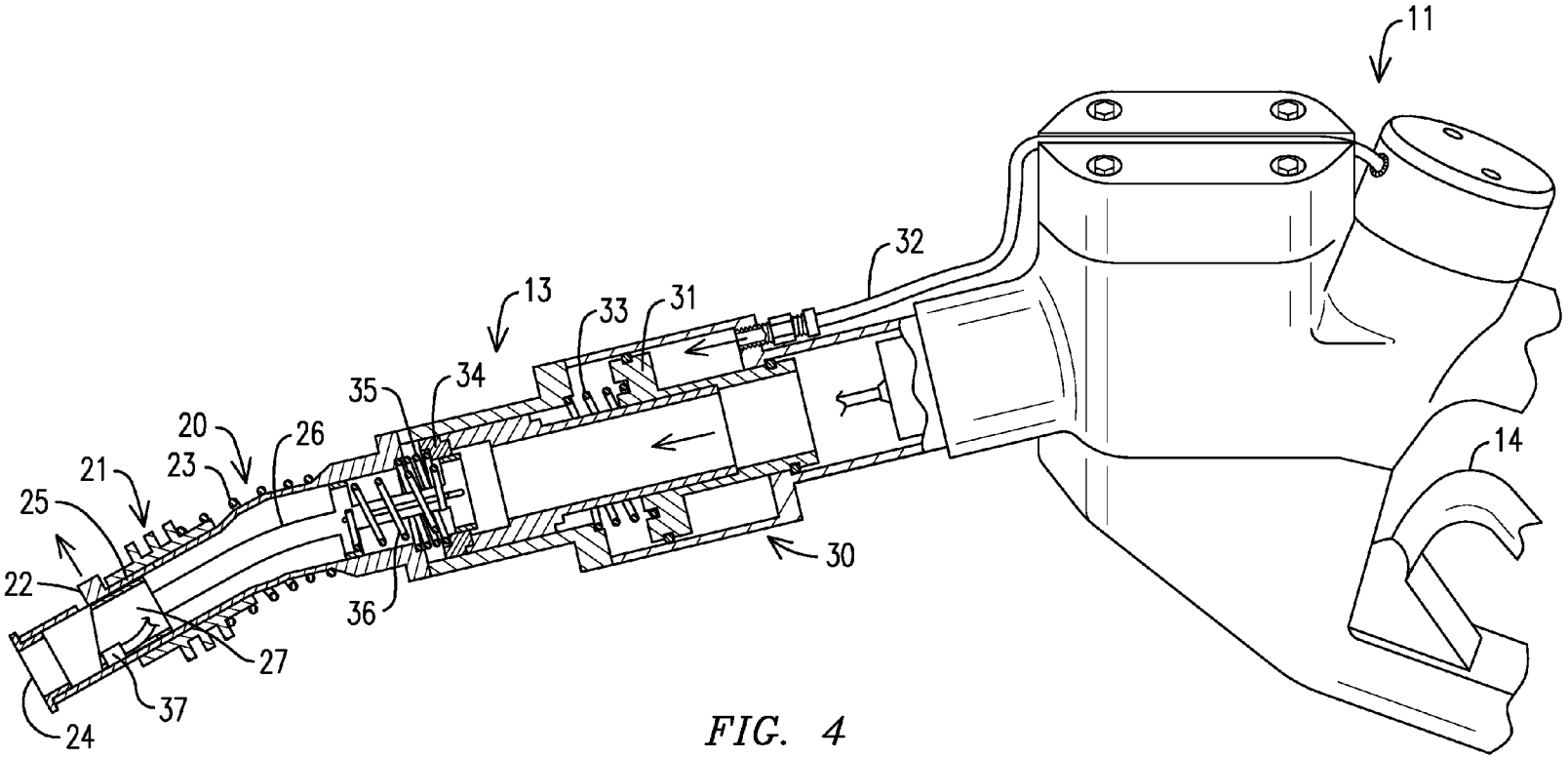
FIG. 4 is a sectional view of a fuel pump nozzle in accordance with the present invention in a locked position.
Figure 5:
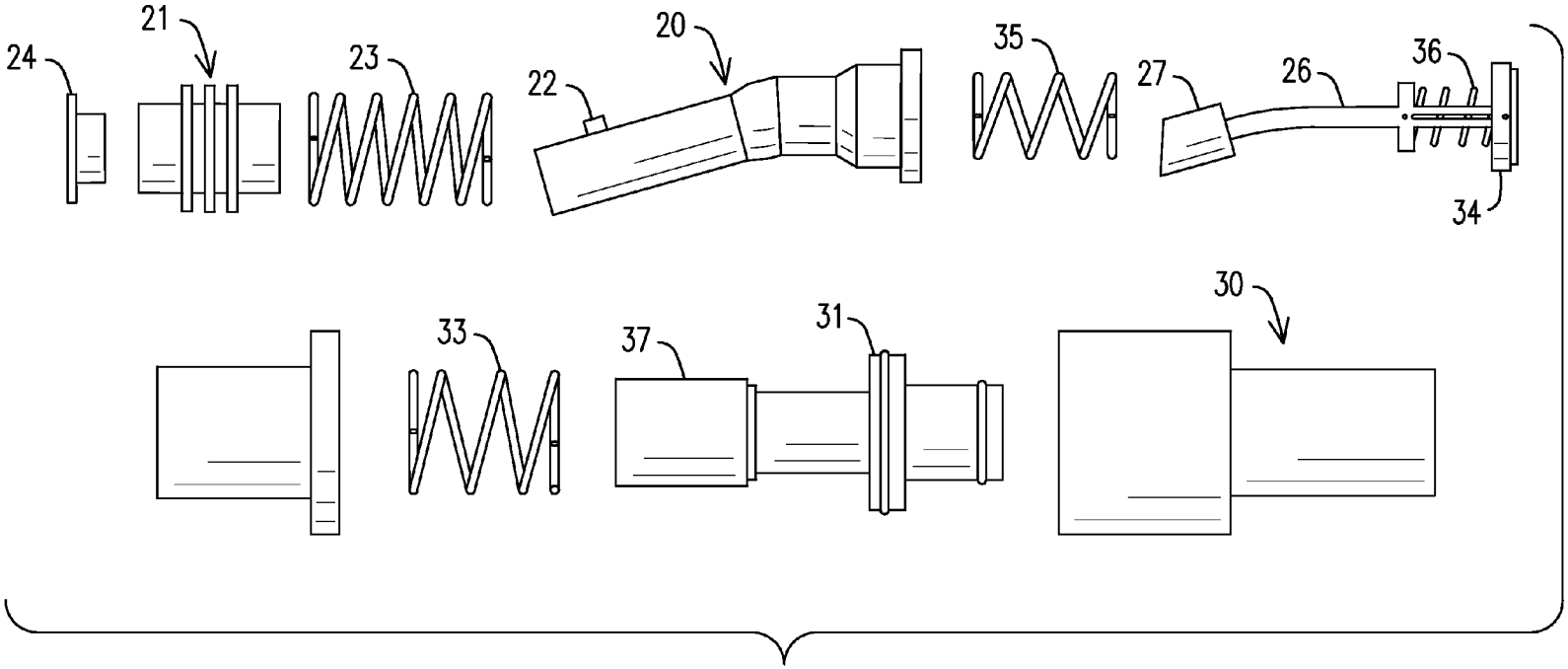
FIG. 5 is an exploded view of the nozzle spout of FIGS. 3 and 4.

In operation, the fuel pump 10 is turned on and fuel fed into the piston housing 30 under pressure. The fuel pressure forces the piston 31 and attached piston extension 37 forward within the piston housing 30 and also compresses the piston return spring 35 against a recess in the nose of the piston housing. This action moves the slip ring 34 forward, compressing the inner pressure relief spring 36 within the actuator 26 and the outer actuator return spring 35. The pressure relief spring 36 is compressed because the actuator 26 itself cannot move forward because the spring 25 with the locking wedge 22 attached is forced down within the nozzle tube 20 by the outer sliding sleeve 21 until the outer sliding sleeve 21 is pushed rearward via the nozzle 11 spout 13 being inserted into the vehicle filler pipe 16. At this point, the actuator 26 moves forward under pressure from the pressure relief spring 36 causing the locking wedge 22, attached to the leaf spring 25, to move up into a locking position. The nozzle 11 is now locked into the filler pipe 16 until the fuel pump pressure is removed via the added switch 15 at the fuel pump 10 being pushed by the customer, thereby turning the gasoline pump off. The nozzle 11 can now be removed and returned to the pump 10. FIG. 3 of the drawings has the fuel nozzle ready for insertion into a vehicle filler tube while FIG. 4 illustrates the nozzle spout when inserted into the filler tube and the locking wedge 22 extending in a locking position.

This safety nozzle is directed towards eliminating fuel spills while the vehicle is being fueled and to minimize static electricity fires while refueling the vehicle. The nozzle cannot be removed by the customer if a fire starts, which is the normal tendency. The nozzle also prevents fuel drips from the nozzle upon removal as a timer can be installed to delay the unlocking of the nozzle until the remaining fuel has drained from the nozzle. The nozzle also prevents an unattended vehicle that is being refueled from having the nozzle removed and inserted into a thief's vehicle to be refueled at the customer's expense.

It should be clear at this time that a safety nozzle for refueling vehicles at a gas station pump has been provided.

However the present invention is not to be considered limited to the forms shown which are to be considered illustrative rather than restrictive.

I claim:

1. A locking fuel pump fuel dispenser nozzle having:

a nozzle connected to a fuel pump and having an elongated spout for insertion into a vehicle filler tube having an annular restrictive opening therein, said nozzle having a manually actuating valve for controlling the flow of fuel from the fuel pump through the nozzle into the vehicle filler tube, the improvement comprising:

a locking mechanism for locking the elongated spout in the vehicle filler tube when filling a vehicle fuel tank, said locking mechanism having a spring biased locking wedge in said elongated spout adapted to extend between an unlocked and a locked position, and said locking mechanism having a slidable actuator coupled to a spring biased slip ring located in said elongated spout and positioned to slide against and move said spring biased locking wedge from an unlocked to a locked position, said locking mechanism having a piston in said nozzle spout coupled to said spring biased slip ring and to said slidable actuator to move said slidable actuator and move said spring biased locking wedge from an unlocked to a locked position when fluid pressure is applied to said piston; and a piston return spring biasing said piston to a retracted position upon the release of fuel pressure thereagainst to allow said spring biased slip ring and slidable actuator to retract to allow said spring biased locking wedge to move from a locked position to an unlocked position;

whereby said elongated spout is locked into said vehicle fuel tank filler tube whenever fuel is flowing through the nozzle into the vehicle filler tube and is unlocked only upon the absence of fuel pressure in the nozzle.

2. The locking fuel pump fuel dispenser nozzle in accordance with claim 1 in which said slidable actuator is slidable on said spring biased slip ring allowing slippage between said piston and said slidable actuator.

3. The locking fuel pump fuel dispenser nozzle in accordance with claim 2 including an outer sliding sleeve slidably mounted over said elongated spout to cover said spring biased locking wedge in an unlocked position.

4. The locking fuel pump fuel dispenser nozzle in accordance with claim 3 in which said outer sliding sleeve is spring biased to return said outer sliding sleeve over said spring biased locking wedge when said spring biased locking wedge is retracted into an unlocked position.

5. The locking fuel pump fuel dispenser nozzle in accordance with claim 4 in which said elongated spout has an end stop to hold said outer sliding sleeve over said spring biased locking wedge in an unlocked position.

6. The locking fuel pump fuel dispenser nozzle in accordance with claim 5 in which said nozzle has a piston housing for housing said piston therein.

7. The locking fuel pump fuel dispenser nozzle in accordance with claim 6 including a fuel pressure tube connecting a nozzle fuel input to said piston housing for applying pressure to said piston when said nozzle has fuel under pressure from said fuel pump.

8. The locking fuel pump fuel dispenser nozzle in accordance with claim 7 in which said spring biased locking wedge is attached to a leaf spring mounted in an opening in said elongated spout.

9. The locking fuel pump fuel dispenser nozzle in accordance with claim 8 in which said slidable actuator has a generally cylinder end portion which slides against said leaf spring thereby moving said leaf spring and said spring biased locking wedge from an unlocked to a locked position when said outer sliding sleeve is withdrawn and said piston moved by fuel pressure in said nozzle.

10. The locking fuel pump fuel dispenser nozzle in accordance with claim 9 in which said outer sliding sleeve is sized to be blocked by the filler tube restrictive opening therein to thereby slide said outer sliding sleeve on said nozzle tube over said spring biased locking wedge.

* * * * *